US007328526B2

(12) United States Patent
Peterson

(10) Patent No.: US 7,328,526 B2
(45) Date of Patent: Feb. 12, 2008

(54) METATARSAL GUARD

(75) Inventor: Ruk Peterson, Endicott, NY (US)

(73) Assignee: Rocky Brands Retail LLC, Nelsonville, OH (US)

( * ) Notice: Subject to any disclaimer, the term of this patent is extended or adjusted under 35 U.S.C. 154(b) by 0 days.

(21) Appl. No.: 09/875,542

(22) Filed: Jun. 6, 2001
(Under 37 CFR 1.47)

(65) Prior Publication Data

US 2002/0184794 A1 Dec. 12, 2002

(51) Int. Cl.
*A43C 13/14* (2006.01)

(52) U.S. Cl. ..... 36/72 R; 36/77 R

(58) Field of Classification Search ..... 36/72 R, 36/77 R
See application file for complete search history.

(56) References Cited

U.S. PATENT DOCUMENTS 460,770 A 10/1891 Barrows
1,164,810 A * 12/1915 Hammond ..... 280/28.11
1,866,006 A 7/1932 Bergstrand
2,392,867 A * 1/1946 Stoner et al. ..... 36/72 R
2,572,948 A 10/1951 Poon
2,615,261 A * 10/1952 La Grotto ..... 33/18.3
3,068,593 A * 12/1962 O'Donnell ..... 36/72 R
3,841,004 A * 10/1974 Gray et al. ..... 36/72 R
4,231,170 A 11/1980 Griswold
4,342,159 A 8/1982 Edwards
4,908,963 A 3/1990 Krajcir et al.
5,457,898 A 10/1995 Fortin et al.
5,878,511 A 3/1999 Krajcir
6,007,748 A 12/1999 Krajcir

* cited by examiner

*Primary Examiner*—Marie Patterson
(74) *Attorney, Agent, or Firm*—Porter Wright Morris & Arthur LLP

(57) ABSTRACT

A unitary one piece molded metatarsal guard has a convex arch portion over the wearer's instep extending from the rear of the wearer's toes to the top of the wearer's instep and integrally molded concave right and left support legs overlying a shoe sole. The right and left support legs extend on opposite sides of the wearer's foot.

13 Claims, 3 Drawing Sheets

METATARSAL GUARD

BACKGROUND OF THE INVENTION

1. Field of the Invention

The present invention concerns a metatarsal guard which is located in the upper of a safety shoe or work boot, for protecting the metatarsal region of the wearer's foot from injury caused by the impact of a falling object.

2. Description of the Prior Art

Safety shoes and work boots are commonly required to protect industrial workers from injury to the foot caused by falling objects. Most safety shoes incorporate a box toe, formed of steel, hardened plastic or other suitable material, to protect the wearer's toes from falling objects. Metatarsal, or instep, guards are also provided to protect the wearer's metatarsal arch, or instep.

U.S. Pat. No. 5,457,898 issued to Fortin et al discloses a plastic metatarsal guard inserted in a safety shoe upper. The guard comprises an arch extending over the wearer's instep from the sole of the shoe on one side of the wearer's foot to the sole on the other side of the wearer's foot. The rear portion of the metatarsal guard protects the metatarsal region of the wearer's foot from the impact of falling objects by absorbing the impact. The metatarsal guard disclosed in the patent is relatively involved compared to the simple, but effective, metatarsal guard of the present invention. Thus, for example, the metatarsal guard disclosed in U.S. Pat. No. 5,457,898 includes longitudinal tongues formed by longitudinal slits which spread apart to follow the movement of the foot and to enhance the flexibility of the metatarsal guard during walking. Furthermore, to compensate for the loss in impact absorption caused by the longitudinal slits, the metatarsal guard requires an integral flap which folds over the top surface of the longitudinal slits.

The metatarsal guard of U.S. Pat. No. 5,457,898, like the metatarsal guard of the present invention, allows the load from a falling object to be transmitted from the metatarsal guard to the sole of the footwear. The arch extending over the wearer's instep in U.S. Pat. No. 5,457,898 is much wider than the arch of the present invention and indeed, the arch disclosed in the patent is so wide that two relatively long side slits are required to facilitate flexing of the metatarsal guard during walking, and to facilitate flexing of the wearer's foot in the crouching position. The metatarsal guard disclosed in U.S. Pat. No. 5,457,898, like the metatarsal guard of the present invention, includes a forward position which extends over the top surface of a toe cap so that the loads from a falling object are also transmitted to the toe cap. U.S. Pat. No. 4,237,170 issued to Griswold also discloses a rather complex metatarsal guard comprising a plurality of elongated generally arched-shaped transversely extending rigid strips which are articulated together to provide a protector assembly.

SUMMARY OF THE INVENTION

In accordance with the present invention, a simple, flexible metatarsal guard is provided of sufficient rigidity and strength to meet the present industrial requirements for impact resistant safety shoes. More specifically, in accordance with the present invention, there is disclosed herein a unitary one piece metatarsal guard to be inserted in the upper of a safety shoe of simple, but effective construction, The metatarsal guard has a molded convex arch portion over the wearer's instep extending from the rear of the wearer's toes to the top of the wearer's instep and integrally molded concave right and left support legs overlying a shoe sole with the leg supports extending on opposite sides of the wearer's foot.

It is therefore an object of the present invention to provide a flexible metatarsal guard of simple construction which is of sufficient rigidity and strength to meet the present industrial requirements for impact resistant safety shoes.

This and other objects, advantages and features of the present invention will become apparent upon consideration of the following description and drawings of a preferred embodiment of the present invention.

DETAILED DESCRIPTION OF THE PREFERRED EMBODIMENT

Figure 1:
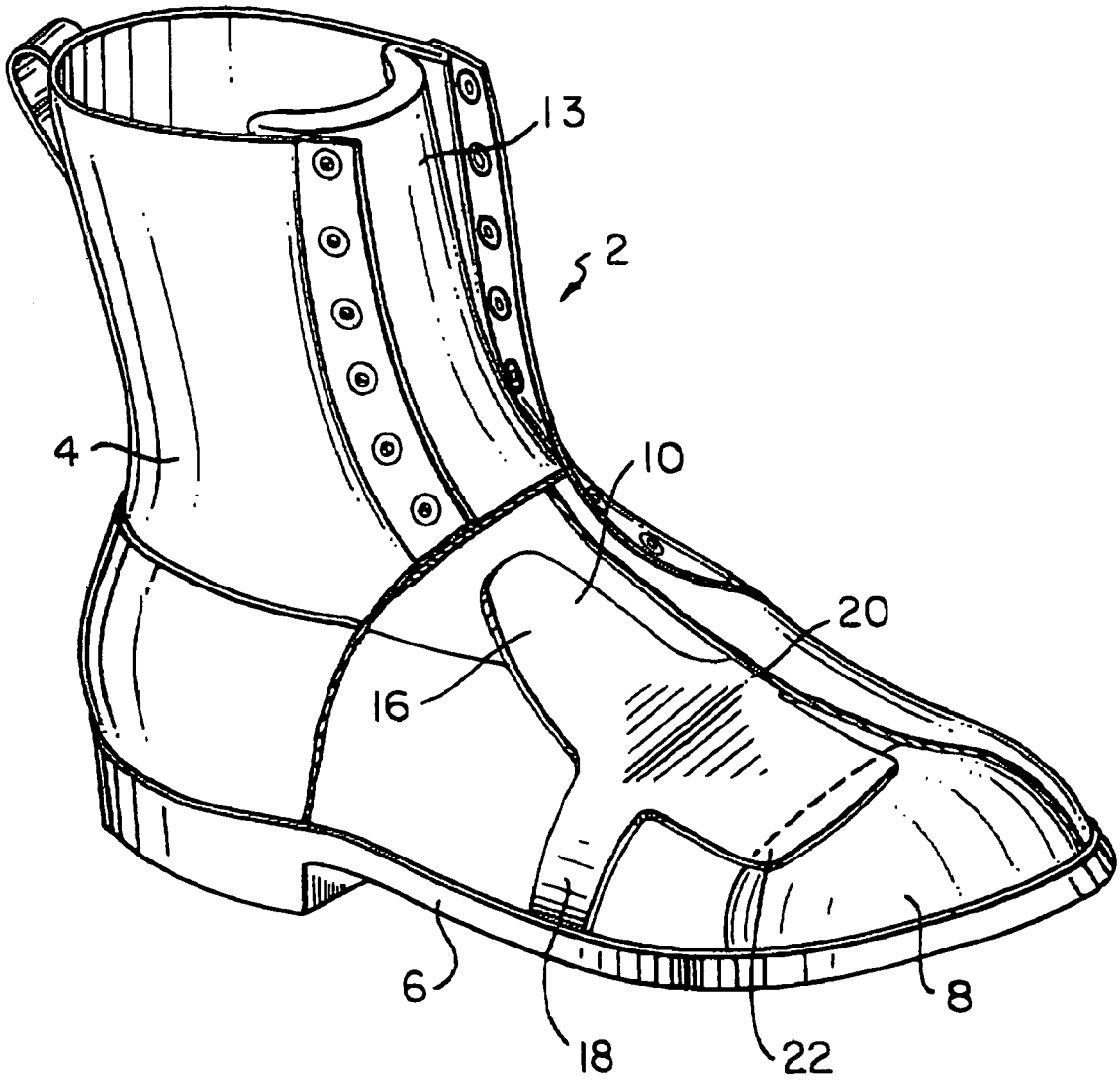
FIG. 1 is a perspective, partial sectional view, of a safety shoe comprising a metatarsal guard in accordance with the present invention.
Figure 2:
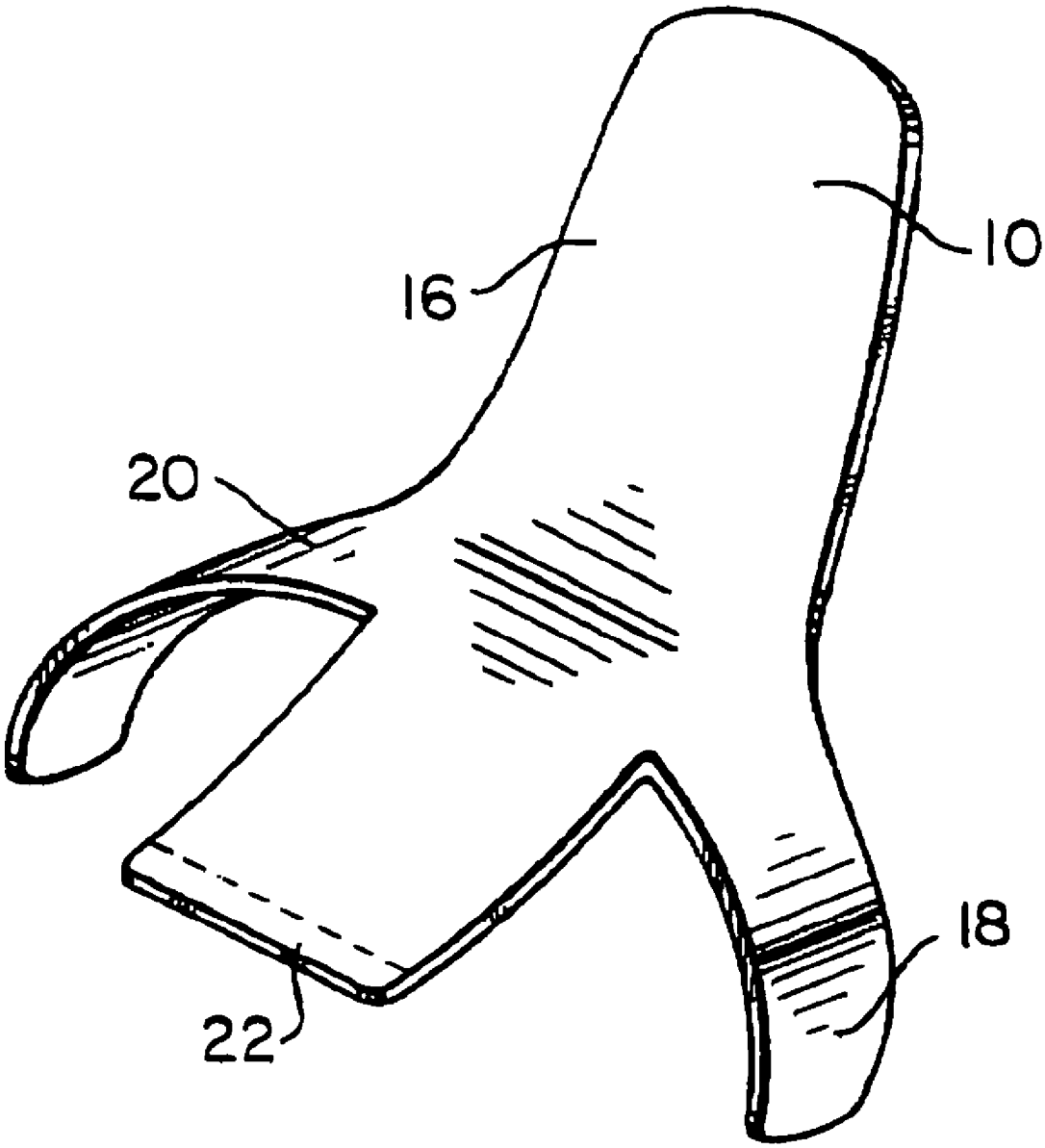
FIG. 2 is a perspective view of a metatarsal guard in accordance with the present invention.
Figure 3:
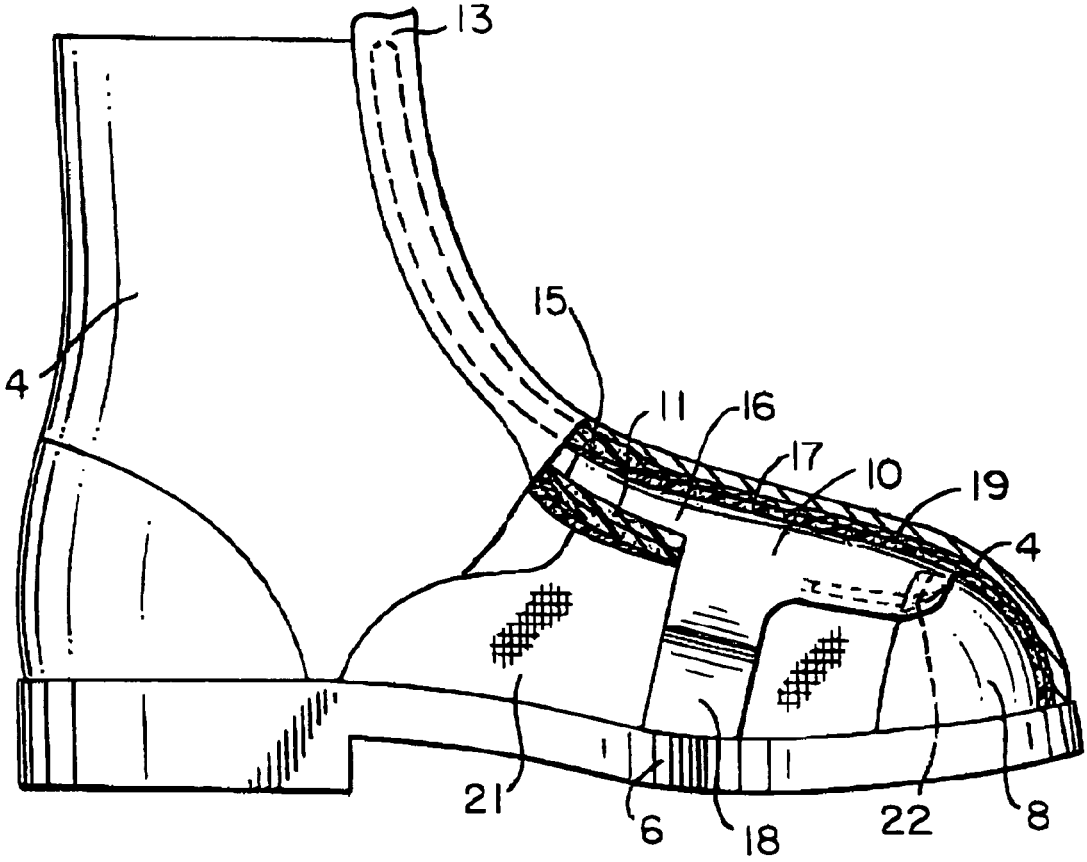
FIG. 3 is a side, sectional view of the safety shoe shown in FIG. 1 and wherein a portion of the safety shoe upper is cut away.

The safety shoe 2 shown in FIGS. 1 and 3 comprises an upper 4, a sole 6, and a conventional toe cap 8, the latter of which may be made of steel, plastic or other materials which will protect the wearer's toes from falling objects. A unitary one piece molded metatarsal guard 10 is embedded within upper 4. The metatarsal guard 10 is shown in FIG. 3 in which a double layer of dense foam 11 is cemented to the bottom surface of metatarsal guard 10. A vamp lining not shown extends beneath the double layer of dense foam 11. A tongue 13 including a foam 15 therein extends over part of the top surface of metatarsal guard 10. The remaining part of the top surface of metatarsal guard 10 is covered by a foam layer 17 having a cloth backing 19 thereon. Cloth backing 19 is cemented to the interior of upper 4. Vamp lining 21 is shown in the cutaway portion of upper 4.

Metatarsal guard 10 is a unitary one piece member molded from slightly flexible plastic material. While various plastic materials may be used, it has been found desirable to form metatarsal guard 10 of high impact thermoplastic acrylonitrile butadiene styrene, known as ABS. The metatarsal guard 10 includes a solid convex arch portion 15 which conforms to the natural shape of the wearer's instep or metatarsal region. The convex arch portion 16 lies over the wearer's instep and extends from the rear of the wearer's toes to the top of the wearer's instep. A solid right concave support leg 18 and a solid left concave support leg 20 are integrally molded with convex arch portion 16 and extend on opposite sides of the wearer's foot. Right and left support legs 18 and 20 have their ends terminating at a position to bear against sole 6, in the event of an object falling on metatarsal guard 10. In that manner the load from a falling object is transmitted from the metatarsal guard 10 to the sole 6. In the preferred embodiment, the surfaces 18 and 20 are of less width than the width of arch portion 16. The forward portion of convex arch portion 16 includes integrally molded lip 22 which overlies and is secured to the rear of toe cap 8 by cement. In that manner the load from an object falling on metatarsal guard 10 will be transmitted, in part, to toe cap 8.

It will thus be understood that the metatarsal guard 10 acts to protect the wearer's foot from falling objects and that the load of the falling object is transmitted to the sole 6 and toe cap 8. Testing of the simple, flexible metatarsal guard 10 of the present invention has shown that footwear including the metatarsal guard 10 of the present invention complies with ANSI Standard Z-41-1999 of the American National Standards Institute for Class 75 footwear.

Although the present invention has been described hereinabove by way of a preferred embodiment, this embodiment can be modified within the scope of the appended claims, without departing from the spirit and nature of the subject invention.

I claim:

1. Footwear comprising a sole, a toe cap, and an upper having a unitary one piece molded metatarsal guard therein for transmitting a load to the sole, said metatarsal guard comprising:

a convex arch portion over a wearer's instep, the convex arch portion having only a single unfolded thickness of material overlying the wearer's instep and defining right and left sides;

a single concave integrally molded right support leg extending downwardly from the right side of the arch portion on the right side of a wearer's foot and in contact with the sole; and a single concave integrally molded left support leg extending downwardly from the left side of the arch portion on the left side of a wearer's foot and in contact with the sole;

the convex arch portion between the right and left support legs comprising a single layer including an integrally molded lip overlying the toe cap and an integrally molded section rearward of the right and left support legs;

the support legs bearing against the sole and the lip and rearward sections of the convex arch portion not bearing against the sole when a load is applied to the metatarsal guard.

2. Footwear as recited in claim 1, wherein the convex arch portion and concave right and left support legs are solid.

3. Footwear as recited in claim 2, wherein the concave right and left support legs have a width less than the width of the convex arch.

4. Footwear as recited in claim 1, wherein the lip is cemented to the toe cap.

5. Footwear as recited in claim 1, wherein the one piece molded metatarsal guard is solid.

6. Footwear as recited in claim 1, wherein the convex arch portion is solid.

7. Footwear as recited in claim 6, wherein the right and left support legs have a width less than the width of the convex arch portion.

8. Footwear as recited in claim 1, wherein the lip is solid.

9. Footwear as recited in claim 1, wherein each of the support legs extends substantially perpendicularly from a longitudinal axis of the convex arch portion.

10. Footwear as recited in claim 1, wherein a support leg extending from a side of the convex arch portion defines an L-shaped notch.

11. Footwear comprising a sole, a toe cap, and an upper having a unitary one piece molded metatarsal guard therein for transmitting a load to the sole, said metatarsal guard comprising:

a convex arch portion over the wearer's instep having an integrally molded lip overlying the toe cap and a section rearward of the right and left support legs;

a single concave right support leg integrally molded with the convex arch portion and extending downwardly from the arch portion on the right side of a wearer's foot and in contact with the sole; and a single concave left support leg integrally molded with the convex arch portion and extending downwardly from of the arch portion on the left side of a wearer's foot and in contact with the sole;

each of the legs having a width less than the width of the lip, the support legs bearing against the sole and the lip and rearward section of the convex arch portion not bearing against the sole when a load is applied to the metatarsal guard.

12. Footwear as recited in claim 11, wherein the lip is solid.

13. Footwear comprising a sole, a toe cap, and an upper having a unitary one piece molded metatarsal guard therein for transmitting a load to the sole, said metatarsal guard comprising:

a convex arch portion over the wearer's instep, the convex arch portion defining right and left sides, an integrally molded lip overlying the toe cap, and an integrally molded section rearward of right and left support legs;

a single concave integrally molded right support leg extending downwardly from the right side of the arch portion on the right side of a wearer's foot and in contact with the sole; and a concave integrally molded left support leg extending downwardly from the left side of the arch portion on the left side of a wearer's foot and in contact with the sole;

each of the legs having a width less than the width of the convex arch portion between the right and left support legs and at least one leg defining an L-shaped notch, the support legs bearing against the sole and the lip and rearward section of the convex arch portion not bearing against the sole when a load is applied to the metatarsal guard.

* * * * *